US010927561B2

(12) United States Patent
Zingerle

(10) Patent No.: US 10,927,561 B2
(45) Date of Patent: Feb. 23, 2021

(54) FOLDING TENT WITH A FLAT ROOF AND A ROOF DEPRESSION

(71) Applicant: Zingerle AG, Natz/Schabs (IT)

(72) Inventor: Georg Zingerle, Natz/Schabs (IT)

(73) Assignee: Zingerle AG, Natz/Schabs (IT)

( * ) Notice: Subject to any disclaimer, the term of this patent is extended or adjusted under 35 U.S.C. 154(b) by 0 days.

(21) Appl. No.: 16/151,759

(22) Filed: Oct. 4, 2018

(65) Prior Publication Data

US 2019/0106901 A1 Apr. 11, 2019

(30) Foreign Application Priority Data

Oct. 6, 2017 (DE) ..... 10 2017 123 194.3
Oct. 6, 2017 (DE) ..... 20 2017 006 819.2

(51) Int. Cl.

| | |
|---|---|
| ***E04H 15/02*** | (2006.01) |
| ***E04H 15/50*** | (2006.01) |
| ***E04H 15/54*** | (2006.01) |
| *E04H 1/12* | (2006.01) |

(52) U.S. Cl.

CPC ..... *E04H 15/02* (2013.01); *E04H 15/50* (2013.01); *E04H 15/54* (2013.01); *E04H 1/1222* (2013.01)

(58) Field of Classification Search

CPC ..... E04H 15/50; E04H 15/48
See application file for complete search history.

(56) References Cited

U.S. PATENT DOCUMENTS 2,912,940 A * 11/1959 Baroni ..... E04B 7/102 52/309.1
3,169,543 A * 2/1965 McGerty ..... E04H 1/12 135/117
4,551,985 A * 11/1985 Kovach ..... E01C 13/105 126/561
4,607,656 A * 8/1986 Carter ..... E04H 15/50 135/122
4,885,891 A * 12/1989 Lynch ..... E04H 15/50 52/646
5,794,640 A * 8/1998 Jang ..... E04H 15/50 135/131
6,112,757 A * 9/2000 Tseng ..... E04H 15/50 135/131

(Continued)

FOREIGN PATENT DOCUMENTS

DE 102011110119 A1 * 2/2013 ..... E04G 21/28
FR 2197396 A5 * 3/1974 ..... E04D 13/0404

(Continued)

OTHER PUBLICATIONS

English translation of JP08004358 from espacenet.com.*

*Primary Examiner* — David R Dunn
*Assistant Examiner* — Danielle Jackson
(74) *Attorney, Agent, or Firm* — Tucker Ellis LLP; Michael G. Craig

(57) ABSTRACT

Tent with a flat roof (7) comprising a supporting framework (6) comprising profile elements (23, 38), a tent roof fabric (2), a depression (8) in the tent roof fabric 2), which merges into a device (9, 50) for attaching the tent roof fabric (2) to the supporting framework (6) and for draining off water, and wherein the device (9, 50) has a hollow space (34) for drainage and is furthermore configured to receive the profile elements (23, 38) and the tent is a folding tent.

6 Claims, 11 Drawing Sheets

(56) References Cited

U.S. PATENT DOCUMENTS

| | | | | |
|---|---|---|---|---|
| 6,345,638 | B1 * | 2/2002 | Warner | E04B 7/14 135/123 |
| 9,714,521 | B1 * | 7/2017 | Aloumanis | E04H 15/54 |
| 2002/0069903 | A1 * | 6/2002 | Hewett | E04H 15/06 135/87 |
| 2003/0101677 | A1 * | 6/2003 | Hewett | E04H 15/06 52/655.1 |
| 2009/0308424 | A1 * | 12/2009 | Danziger | E04H 15/48 135/141 |
| 2010/0065095 | A1 * | 3/2010 | Yul | E04H 15/32 135/121 |

FOREIGN PATENT DOCUMENTS

| | | | | | |
|---|---|---|---|---|---|
| GB | 1018978 | A | * | 2/1966 | E04B 1/32 |
| JP | 08004358 | A | * | 1/1996 | |
| JP | 2000034850 | A | * | 2/2000 | |
| JP | 6151833 | B1 | * | 6/2017 | |
| WO | WO-2017002141 | A1 | * | 1/2017 | E04B 1/344 |

* cited by examiner

FOLDING TENT WITH A FLAT ROOF AND A ROOF DEPRESSION

RELATED DOCUMENTS

This application claims priority to German Patent Application No. 10 2017 123 194.3, filed Oct. 6, 2017, and titled TENT WITH A FLAT ROOF AND A ROOF DEPRESSION, and claims priority to German Patent Application No. 20 2017 006 819.2, filed Oct. 6, 2017, registered on Sep. 6, 2017, and titled TENT WITH A FLAT ROOF AND A ROOF DEPRESSION, all of which are incorporated by reference in their entirety.

BACKGROUND

The patent application WO 2013/016830 A1 reveals a deployable and retractable fabric construction arranged on an inwardly inclined glass roof which serves the purpose of protecting crops against climatic conditions and can thus be regarded as a kind of shading curtain for a greenhouse.

The German patent application DE 32 40 262.7 A1 shows an example of use in a large-area greenhouse, in which a so-called skin is provided, which is clamped diagonally to the outside in fastening elements, which in turn are connected to open, cross-shaped gutters so that rainwater can flow from the skins sloping down to the gutters, where it can then drain off by means of a drain pipe.

The US patent application US 2002/0069903 A1 shows various design features of a drain pipe.

The Japanese patent application JP 08004358 A shows a flat, horizontally tensioned tent fabric, which lowers towards its center so that rainwater can run off via a drain pipe arranged there.

From the construction of buildings with flat roofs or gently sloping roofs, a wide variety of roof drainage systems is known, which in turn must regularly meet the requirements of various standards, regulations and guidelines.

Flat roofs of buildings comprise complex substructures or supporting layers, which exist either in the form of a heavy, rigid substructure made of reinforced concrete or in the form of a lightweight, flexible structure with a framework or skeleton made of wood, steel, reinforced concrete and other parts. In addition, there are layers of bitumen, chippings, separating and levelling layers, vapor barrier layers, thermal insulation layers, roof sealings, cover layers such as gravel, slabs and the like.

As a result, these flat roofs with their high structures allow the use of a variety of roof drainage systems, for example systems which follow the principle of gravity drainage or vacuum drainage systems.

The aforementioned structure of flat roofs for buildings is naturally out of the question for tents the roofs of which usually consist only of one layer of fabric.

That is why tents always have cone-shaped, pyramid-shaped, more or less high and pointed tent roof structures. Tents with roofs in a so-called pagoda shape, i.e. a high and pointed roof shape, are often chosen precisely because they allow rainwater to run off well on usually four sides of the roof.

So-called tents with flat roofs are also always tents which have a lower roof pitch, but which cannot do without such a roof pitch, and which, for example, have one configured in the form of a ridge so that rainwater can run off at the roof pitches of the tent roof.

The same applies to inflatable tents, which have hemispherical shapes, for example as so-called party tents.

This means that such tent roof structures usually do not require separate roof drainage systems.

However, this would be different for tents with a real flat roof, because ponding of water can occur at various positions, which can lead to a moisture penetration of the fabric of the tent roof, but also to serious static problems in the overall structure of the tent due to the weight associated therewith.

Nevertheless, it is desirable for various reasons to provide tents with real flat roof structures which avoid the drawbacks of the state of the art described above.

SUMMARY

The present invention relates to a folding tent with a tent roof fabric configured in the form of a flat roof and with a roof depression according to claim 1.

It is therefore a problem of the invention to develop a tent roof as a real flat roof in which ponding of water at unpredictable or undesired positions of the flat roof is avoided.

In this context, it is a problem of the invention to drain off water existing on the real flat roof, for example as a result of rain, in a reliable manner and with low construction effort and hence also cost-effectively.

In addition, it is desirable to develop such a tent with a real flat roof also as a folding tent.

A further aspect is to increase in some kind of way the space for advertising, which is becoming more and more important also for tents.

This problem is solved by a tent according to claim 1. Preferred embodiments of the tent are described in the sub-claims.

In the present case, a tent is understood to be a temporary, simple and preferably portable construction.

A tent within the meaning of the invention comprises, inter alia, "classic" tent configurations, folding tents, rescue tents, beer tents, kiosks, storage tents, event tents, pavilions, scissor-type tents, quick pitch tents, sales stands, promotion stands, bar pavilions, pagoda tents, tents for "tent cities". For example, they can have square, rectangular, hexagonal, octagonal floor areas. They can be set up and/or taken down with or without tools at almost any location. They can also be intended for permanent use.

A tent is characterized in that it comprises, inter alia, a framework made of profile elements and a roof placed above it. The framework of profile elements is part of the supporting framework.

Supporting framework within the meaning of this invention is the term used to describe the overall static system of the roof structure of a tent. It comprises, inter alia, the aforementioned profile elements as a support system for the tent roof, connecting elements for the connection of the profile elements, bolted joints, flanges. Profile elements and profile supports are used as synonymous terms.

The profile elements of the supporting framework are mainly made of aluminum. However, other metal and plastic materials or wood can also be used.

In recent times, so-called folding tents, which are also referred to as quick pitch tents, have become more and more important. Their advantage lies in the fact that they are mainly delivered with the roof already assembled, that it is not necessary to dismantle the roof when setting up and taking down the folding tent, and that the setting up and dismantling can usually also be carried out without tools.

Such folding tents are folded in the delivery state. When the tent is set up, a structure opens up as a result of the tent being pulled apart above scissor-type grid profiles arranged on the outer sides of the supporting framework and running circumferentially around it. The scissor-type grid profiles are likewise profile elements and are thus also part of the supporting framework.

The pre-assembled roof is tensioned automatically. For this purpose, the corner supports of the tent are therefore connected to a roof structure having the shape of a scissor-type grid, which enables the tent to be pulled apart when being set up.

Regardless of the respective configuration of a tent, the tent roof usually rests on the ends of the supports which are at the top in the set-up state, in particular on the corner supports arranged at the corners of the tent roof, and spans them by means of its tent roof fabric.

Additional supports, for example in the center of the tent or on the long sides or front sides of the tent, may be provided.

If the tent has a rectangular or square floor plan, it has at least four supports. A polygonal tent has a corresponding plurality of supports.

The supports in turn can be arranged on the bottom side in separate feet, which is already suitable when setting up a tent on a lawn, the ground, sand or the like.

The material of the supports can comprise wood, bamboo, plastic or metal. It is preferred that aluminum is used for the supports.

The geometrical configuration of the respective support is basically of no importance. Within the scope of the present invention, an octagonal configuration of a support in the form of a hollow profile is assumed merely by way of example, i.e. without being limited thereto.

The outer wall of the support can be smooth, ribbed, corrugated or have any other desired configuration.

The roof structure of the tent rests on the end of the supports which is at the top in the set-up state of the tent. In the case of a square tent structure, the four respective corner areas of the tent roof are therefore disposed on the supports correspondingly arranged in a square.

A connection between the supports and the corner areas of the tent roof is preferably made in the form of a hinged connection. However, this hinged connection as such is not the subject matter of the present invention.

In the set-up state of the tent, this connection is covered by a screen, which can contain, for example, advertising, company names, brands or other information. Due to the structure of the supporting framework in the form of a flat roof described below, it is possible to reduce the overall height of the tent, since high roof shapes, for example pagoda shapes, roof ridges, can be omitted. In comparison to conventional tents of this type, this allows the supports to be extended without the tent reaching an overall height of conventional tents, thereby increasing the surface area of the screen and thus providing more space for such information.

The supports are connected to each other by means of connecting elements. At least two scissor-type grid sections run on each outer side of an exemplary supporting framework of a square tent structure according to the invention. Each scissor-type grid section has at least two profile elements. The supports, in particular the corner supports, are thus circumferentially connected to each other by means of profile elements on the four sides of a square tent structure or on the corresponding sides of a polygonal tent structure. The profile elements in their configuration in the form of scissor-type grid sections running circumferentially around the outer sides of the supporting framework in turn can likewise be connected to each other by means of one or more connecting elements.

The profile elements forming the scissor-type grid profile on the sides of the tent, extending to each other at an angle and hinged together can be brought into contact with each other substantially vertically in a folded state.

In the set-up state, the profile elements extend in a scissor shape beneath the tent roof.

The tent roof is formed, inter alia, by the tent roof fabric.

Tent roof fabric is understood to mean any material used for tents, for example reinforced vinyl, cloth, polyester, PVC, nylon, polyurethane, impregnated fabrics, plastic foils or mixed fabrics.

It is an essential aspect of the present invention that the tent is designed with a flat roof in the form of what is referred to here as a real flat roof. As will become clear below, the term "flat roof" does not mean that the roof has to be configured in the form of a uniformly flat surface, since it has a roof depression as is explained below, i.e. it is lowered towards its center. This means, among other things, that due to its structure, it does not need to have a tent roof fabric or supporting framework which is higher than the upper end of the supports in order to provide effective drainage.

According to the invention, the tent has a flat roof comprising a tent roof fabric as described above.

As has already been summarized above, the tent has a supporting framework comprising a plurality of profile elements, which are preferably configured in the form of aluminum tubes. The profile elements do not only form the aforementioned scissor-type grid sections, which connect the supports of the tent to each other on their outer sides. Rather, the profile elements also either form further scissor-type grid sections, which extend from the scissor-type grid sections running circumferentially around the outer sides towards the inside of the tent, i.e. towards the point where the roof depression is located, which will be described in more detail below, or they run in another way, i.e. without forming a scissor-type grid shape, in the direction of the inside of the tent towards the roof depression.

Therefore, in the case of an exemplary supporting framework of a square tent structure according to the invention as has been described so far, this means that two scissor-type grid sections connecting the (corner) supports to each other are located on each outer side of the tent, i.e. a total of eight scissor-type grid sections on all four sides. In the case of a tent having more than four corners, the number of scissor-type grid sections increases accordingly.

In the set-up state of the tent, each of these scissor-type grid sections running circumferentially around the outer sides has ends which are arranged vertically spaced apart from each other on the respective (corner) support of the tent. From this point, the profile elements of the scissor-type grid section extend towards the center of the respective outer side by crossing each other.

Two embodiments of the invention are possible. In both embodiments, the two ends of the scissor-type grid sections, which are spaced apart from each other in height, are attached to the respective (corner) support by means of an upper and a lower connector in the set-up, i.e. unfolded, state of the folding tent. The attachment can be configured to be movable in height so that the distance between the ends of the scissor-type grid sections may be variable depending on whether they are unfolded or folded. However, the attachment may also be fixed so that unfolding and folding of the folding tent essentially takes place via the hinged connection in the connecting area of the adjacent scissor-type grid sections.

The two aforementioned embodiments differ primarily in that in the first embodiment, the distance between the two spaced apart ends of the scissor-type grid sections when attached to the respective (corner) support and/or their positioning on the respective (corner) support is different in comparison to the second embodiment.

The apparent difference between the two embodiments is that the upper one of the two connectors in the second embodiment is positioned at the upper end or in the area of the upper end of the respective (corner) support, which is not the case in the first embodiment. In the first embodiment, it can clearly be seen that the upper one of the two connectors is attached to the respective (corner) support beneath the upper end thereof.

As the term already implies, the two lower connectors are, of course, arranged beneath the upper connector in both embodiments.

The aforementioned different embodiment of the invention also allows constructional differences in the area of the supporting framework, without this, however, leading to a basically different subject matter of the invention.

On the basis of the above statements, the so-called first embodiment will now be explained in more detail.

As a result of their running crosswise, the ends of the profile elements of this scissor-type grid section in turn are spaced apart in the set-up state of the tent. At these end points, the ends of the profile elements are connected by means of connecting elements to the corresponding ends of the profile elements of the adjacent scissor-type grid section. This adjacent scissor-type grid section in turn runs with profile elements crossing each other towards the adjacent (corner) support, where the ends of the profile elements of this adjacent scissor-type grid section in turn are arranged vertically spaced apart from each other on the aforementioned adjacent (corner) support. The arrangement is carried out by means of an upper and a lower connector. In the first embodiment, the upper connector is spaced apart from the upper end of the (corner) support, which means that it is arranged on the (corner) support lower than the upper end of the latter.

Insofar as in the context of the above a scissor-type grid section is mentioned, it is expressed that the profile elements crossing each other form a scissor-type grid section, and two or more adjacent scissor-type grid sections form the scissor-type grid.

As mentioned above, the ends of the profile elements of the scissor-type grid sections are vertically separated from each other at the point where they meet for their connection, i.e. for the connection of the adjacent scissor-type grid sections. The connecting elements connecting the ends of the profile elements of the scissor-type grid sections are therefore also vertically spaced apart from each other. The upper connecting element thus connects the ends of the profile elements of the scissor-type grid sections which converge at the top, while the lower connecting element connects the ends of the profile elements of the scissor-type grid sections which converge at the bottom.

From the connecting elements of a square tent structure connecting these scissor-type grid sections to each other, at least four profile elements extend towards the inside of the tent, which—as will be explained in more detail below—run towards each other in the center of the tent roof structure, and which are connected to each other via a preferred four-way connecting element.

The connecting elements are preferably configured in the form of three-way connectors or T-connectors. Branching off at an angle from the connecting axis of the scissor-type grid sections running circumferentially around the outer sides, the connecting elements also receive these further scissor-type grid sections, which run from the scissor-type grid sections running circumferentially around the outer sides towards the inside of the tent, i.e. towards the point where the roof depression is located, which will be described in more detail below.

The last-mentioned profile elements running towards the inside of the tent are thus received with their respective ends by the upper connecting element and the lower connecting element. As they also cross each other, they likewise have vertically spaced apart ends at their ends which are opposite to this starting point in the area of the inside of the tent.

These last-mentioned vertically spaced apart ends inside the tent merge in the longitudinal axis and, in the case of a square tent, from all four outer sides in two transverse axes into one connecting element each and are fixed by it.

These scissor-type grid sections directed into the inside of the tent thus run crosswise towards each other inside the tent in the area of the roof depression and are connected to their respective ends of the profile elements by means of vertically spaced apart four-way connectors arranged there, of which the upper four-way connector receives the end of the profile element hinged at the top and the lower connector the end of the other profile element hinged at the bottom.

This overall structure of scissor-type grid sections, scissor-type grids, profile elements and connectors as described above thus forms the supporting structure. The supporting framework therefore represents the roof structure of the tent.

In the central position of its floor plan, the tent roof fabric has the already mentioned roof depression directed downwards in order to achieve the configuration in the form of a real flat roof. Rainwater or, for example, meltwater flows together in this roof depression.

In order to allow such water to run off the flat roof, the roof depression is provided with an opening, i.e. it is configured to form a kind of eye, which can, if necessary, be reinforced with fabric or provided with a reinforcing ring in order to prevent tearing.

The roof depression merges via this opening into a device to which the tent roof fabric is attached as described below.

However, as far as the attachment of the tent roof fabric to this device is concerned, the function of this device is not fully described, since it does not only serve to attach the tent roof fabric to the supporting framework.

Due to its arrangement and configuration, the device also serves as a water drain.

According to the invention, the device also has another and thus altogether a triple function: It is also a means of connecting the scissor-type grid sections directed into the inside of the tent to each other, i.e. it is also the four-way connector already mentioned above.

The device for attaching the tent roof fabric as well as for draining off water thus receives the component which serves to connect the profile elements directed from the outer sides of the tent into the inside of the tent. For this purpose, the connection part of a square tent is configured in the form of a four-way connector and has corresponding parts for hinging the profile elements to the four-way connector.

The profile elements of a square tent which are directed from the scissor-type grid sections running circumferentially around the outer sides into the inside of the tent thus converge at the connecting element configured in the present example in the form of a four-way connector. This connecting element has a tubular hollow space, into which a drain part to be described in more detail below is inserted.

The device for attaching the tent roof fabric and for connecting the profile elements directed into the inside of the tent is therefore configured in such a way that it alone enables a connection to the drain pipe. The aforementioned second embodiment will now be described in more detail. In this respect, the description given above for the first embodiment also applies in its entirety to the second embodiment so that, in order to avoid unnecessary repetitions, this description is also made the subject matter of the description for the second embodiment, with the proviso of the following deviations:

In the second embodiment, the upper corner connector is arranged at the upper end of the respective (corner) support of the folding tent, while the lower corner connector—as compared to the first embodiment—can remain approximately at the position beneath the respective (corner) support. By raising the connection, the scissor-type grid running circumferentially around the outer sides is also moved upwards. This ensures that the tent roof fabric can additionally rest on its outer sides on the scissor-type grid running circumferentially around the outer sides. This has the advantage that the tent roof fabric is additionally supported in case of heavy rain or snow load. This also prevents unwanted ponding of water, also known as pooling, from occurring.

As a result, both upper ends of the scissor-type grid section running circumferentially around the outer sides of the tent are approximately in a position in terms of height corresponding to the raised upper corner connector, which is arranged at the upper end of the (corner) support. This means that the upper three-way connector receiving the adjacent scissor-type grid section running circumferentially around the outer sides is also located in a position in terms of height which corresponds approximately to the position of the raised upper corner connector.

The lower three-way connector, which connects the downwardly extending profile elements of the scissors-type grid sections to each other at their ends, remains approximately at a height corresponding to the arrangement of the lower corner connector.

Also in this second embodiment, there is an approximately centrally arranged roof depression, which serves the purpose of receiving and connecting to a device for attachment, connection and drainage, with the result that in the second embodiment, too, this device is arranged at a lower level than the upper end of the (corner) supports and at a lower level than the upper end of the upper three-way connector.

However, the result of the roof depression is achieved in a different way than in the first embodiment:

That is to say the second embodiment does not have scissor-type grid sections branching off from the upper and the lower three-way connectors towards the inside of the tent.

Instead, profile elements only branch off from the upper three-way connectors, which meet centrally in the area of the roof depression in the (only) central connector and are attached there. From the higher starting point of the upper three-way connector, these profile elements directed into the inside of the tent thus run towards the inside of the tent, sloping down to the roof depression and to the central connector. In the case of a square tent, the central connector is configured in the form of a four-way connector.

Profile elements also extend from the lower three-way connectors in the direction of the inside of the tent. However, they no longer run towards a central connector in the vertical axis beneath the roof depression or the device for attachment, as is the case with the first embodiment. The profile elements thus no longer form scissor-type grid sections crossing each other. Rather, the profile elements directed into the inside of the tent each replace one profile element of the scissors-type grid section and form supports instead. For this purpose, the profile elements directed into the inside of the tent and extending from the lower three-way connectors run at an angle upwards in such a way that they are hinged approximately in the center to the profile elements directed into the inside of the tent and extending from the upper three-way connectors and support them in their course to the central connector.

According to the invention, a drain part is provided in the area of the roof depression of the tent roof. This drain part has a continuous hollow space for the intake of rainwater or meltwater.

On its side facing the roof depression, i.e. in its upper part, the drain part has a configuration which receives the aforementioned roof depression with the opening, which is thus configured to form a kind of eye and which can be reinforced with fabric if necessary. The roof depression of the tent roof fabric is thus attached in this upper area of the drain part.

This is followed by a further area of the drain part, which receives the central connector. As described above, the upper four-way central connector is the one where the aforementioned profile elements directed into the inside of the tent are hinged, the ends of which are directed towards this central connector. In the case of a square tent, the central connector is a four-way connector; in the case of a tent with further corners, it is a connector configured according to this number of corners.

Thus, in this second embodiment, there is now only one central connector and no longer an upper and a lower central connector as is the case with the first embodiment. For the purpose of receiving the drain part by the four-way connector, the four-way connector is designed with a hollow space, into which the drain part can be inserted.

In its lower area, the drain part merges into the actual drain pipe, which drains the rainwater or, for example, the meltwater accumulating via the roof depression away from the roof depression.

According to the invention, a device is therefore provided which, on the one hand, serves to attach the tent roof fabric in the area of its roof depression to the supporting framework, and, on the other hand, to connect the profile elements directed from the circumferential outer sides of the tent into the inside of the tent and, at the same time, to drain off the rainwater and/or, for example, the meltwater flowing into the drain pipe via the roof depression.

The drain part will now be described in more detail: In one embodiment, it can preferably comprise three individual pipe elements, which are connected to each other by means of conventional pipe connection measures. If required, the drain part can, of course, be formed as a single piece right from the beginning, for example by means of injection molding or a 3D printer.

In the preferred configuration of pipe parts, the drain part has an upper roof depression connection part, which ensures that the tent roof fabric, i.e. the roof depression provided with an opening, which is configured to form a kind of eye and, if necessary, is reinforced with fabric or may be provided with a reinforcing ring, is connected to the supporting framework via the roof depression connection part. For this purpose, the roof depression connection part has a tubular configuration, at the upper end of which an upper circumferential projection, for example a flange, a bead or the like, is arranged, which comes to rest on the opening of the roof depression of the tent roof fabric, which is configured to form a kind of eye. For this purpose, the drain part or the roof depression connection part is inserted or screwed from above through the eye opening of the roof depression, with the bottom side of the upper circumferential projection of the roof depression connection part coming to rest on the eye-type opening of the tent roof fabric.

The roof depression connection part, which has a tubular configuration, is inserted with its tubular part into a fitting, which, in the case of a three-part configuration of the drain part for example, is the central component and which also has a tubular configuration. The fitting is preferably the shortest part of the three components of the drain part in terms of height. It also has a projection running circumferentially around its upper area, which can, for example, be configured in the form of a flange, a bead or the like. This circumferential projection is referred to as a lower circumferential projection, because when the roof depression connection part and the fitting are joined together, it comes to rest on the bottom side of the upper circumferential projection of the roof depression connection part in such a way that the eye-shaped configuration of the opening of the roof depression of the tent roof fabric comes to rest between these two projections.

The upper circumferential projection of the roof depression connection part and the lower circumferential projection of the fitting thus receive the eye-shaped opening of the roof depression, preferably, for example, in an adhesive, clamped or other fixed manner. For example, the eye-type opening of the roof depression can be reinforced with all-round eye reinforcements, which are inserted into corresponding pins of the lower projection or the upper projection of the fitting or, respectively, of the roof depression connection part so that the tent roof fabric is fixed to the drain part in this way.

The fitting in turn is inserted with its tubular part into a preferably conically widened receiving piece of a pipe connection part. The pipe connection part is a kind of sleeve pipe and is the actual transition of the drain part into the drain pipe or can be part of the drain pipe itself. The pipe connection part (sleeve pipe) has also a tubular configuration.

The roof depression connection part, the fitting as well as the pipe connection part are thus connected to each other in the usual way of pipe connection, i.e. they are, in particular, inserted into each other and sealed and securely connected in the usual way. For this purpose, the connection may be separable or inseparable.

For example, the respective pipe parts of the roof depression connection part and the fitting as well as the pipe connection part are connected in a butt or overlapping manner, for example by means of fillet welds. They can be secured against unintentional opening by other measures, for example they can be equipped with external threads, by means of which external screw connections are arranged; other measures of fixing and securing are also at the discretion of the person skilled in the art.

As described above, the pipe connection part (sleeve pipe) merges into the drain pipe or is part of it. The drain pipe is guided vertically downwards a bit and then merges into a bend, also referred to as an elbow, which in turn merges into a linearly guided pipe, which is guided with a slight inclination directed towards the ground, for example to the outer side of the tent, so that the water running off can be drained away via the end of the drain pipe according to the intended purpose.

In another embodiment of the device for attachment, connection and drainage, the device has a connection part and a drain part. Both parts thus have different functions; in terms of construction, however, they can be configured as one component. They preferably have a filter or a strainer in order to avoid clogging caused, for example, by dirty rainwater, fallen leaves or the like.

For this purpose, the device for attachment, connection and drainage is also preferably made up of several parts. Preferably, it receives the actual connection part and the strainer, with the term "strainer" also including synonymous terms such as filter or other components for the segregation or separation of substances or fluids.

The actual connection part comprises the central connector. The central connector receives the hinged connection of the profile elements directed into the inside of the tent.

The connection part also has a hollow space, through which the rainwater can drain off. For this purpose, it is preferred that the connection part has a tubular configuration and thus forms a receiving device for the drain pipe as well as the elbow of the drain pipe, as has already been described for said one embodiment.

On its upper side, the connection part has a receiving space to receive a fitting of the strainer. The strainer is inserted, screwed or otherwise fixed into this receiving space by means of the fitting, which may be an integral component of the strainer.

The upper side of the connection part is also provided with a lower circumferential projection, on which the opening of the tent roof fabric reinforced with eyes, for example, is placed. This opening of the tent roof fabric is attached by fixing the strainer, which also has an upper circumferential projection, in the receiving space. The opening of the tent roof fabric reinforced with eyes, for example, is thus clamped between these two projections.

The strainer may have web-shaped strainer profiles or comparable separation profiles.

The strainer and the connection part are preferably connected by means of a connecting element, for example a screw, in a permanent but preferably detachable manner.

The two embodiments can each be used in both configurations described above in respect of the different guiding of the profile elements directed into the inside of the tent.

The device for attaching the tent roof fabric and for connecting the profile elements directed into the inside of the tent is therefore configured in such a way that it alone allows a connection to the drain pipe.

Preferably, the tent structure described above is that of a folding tent.

BRIEF DESCRIPTION OF THE DRAWINGS

For a better understanding of the present invention, reference is made exclusively for the purpose of exemplary illustration and without any restrictive effect to an exemplary embodiment according to the figures below, which show.

DETAILED DESCRIPTION

Figure 1:
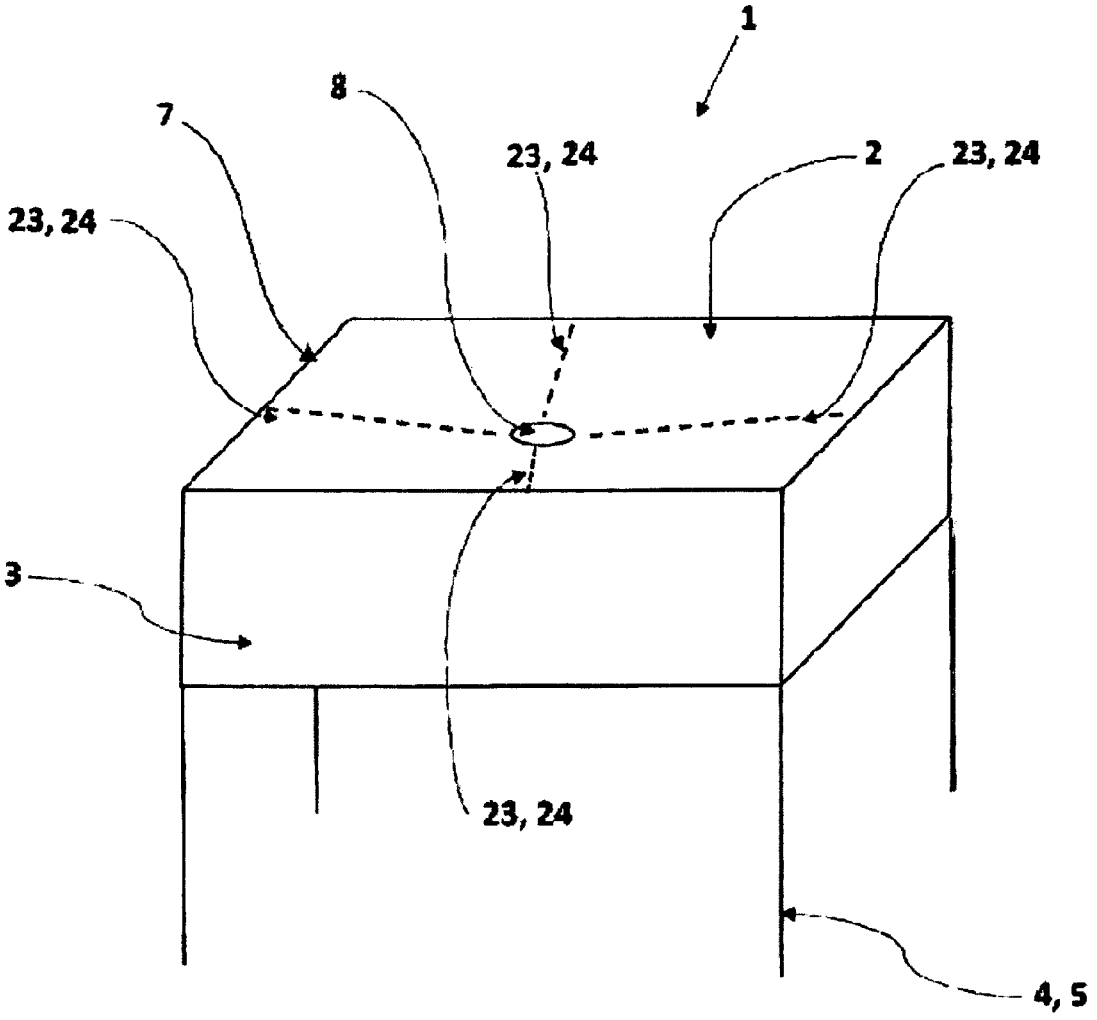
FIG. 1: a schematic diagram of a tent with a flat roof and a roof depression.

In an exemplary embodiment according to the first embodiment, the tent 1 has a flat roof 7, which comprises a tent roof fabric 2 as described above. The tent roof fabric is guided in such a way that it leads into a roof depression 8, which is located beneath when viewed horizontally. The supporting framework, on which the tent roof fabric rests, is therefore not higher than the upper end of the supports 4, 5. The tent has a circumferential screen 3 and, in the present example, is arranged on a supporting structure 4 with four supports 5.

Figure 2:
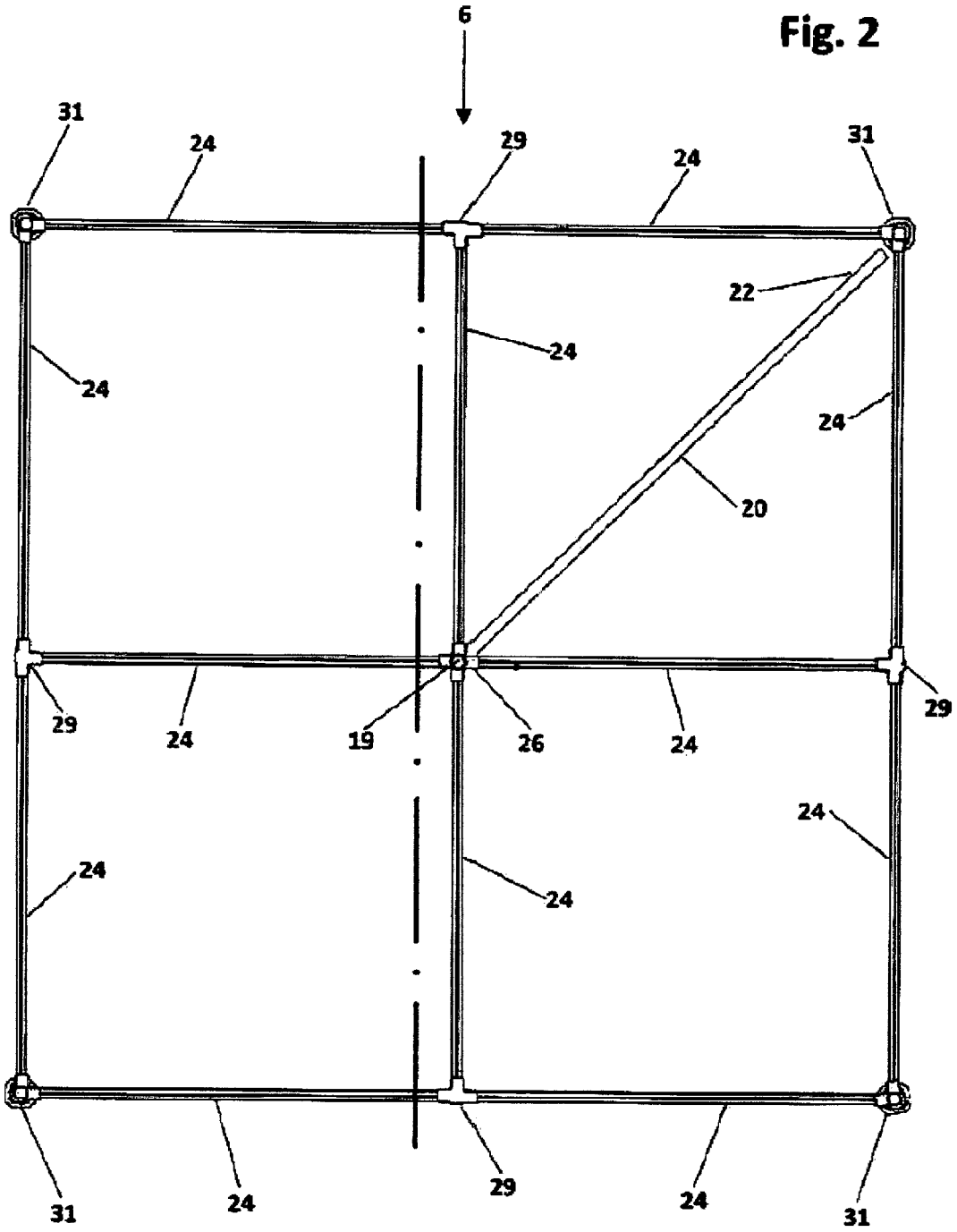
FIG. 2: a profile view of the supporting framework according to the first embodiment as viewed from above.

FIG. 2 reveals the basic structure of the supporting framework 6 using the exemplary embodiment of a square tent. On each of its respective sides, the tent has two scissor-type grid sections 24 comprising profile elements (shown in plan view), which lead at their outer ends into corner connectors, which in turn are connected to the supports 5 (not shown) of the tent 1. FIG. 2 shows the upper corner connectors 31.

It can also be seen in FIG. 2 that there are (upper) three-way connectors 29 in the center of each of the outer sides, which receive the profile elements of the scissor-type grid sections 24 leading into them. The three-way connectors 29 are not only configured in such a way that they receive the profile elements 23 of the scissor-type grid sections 24 running on the outer sides in their longitudinal axis, but due to their T-shaped configuration, they are also configured in such a way that they receive the profile elements of the scissor-type grid sections 24 directed inwards into the tent. These profile elements of the scissor-type grid sections 24 directed inwards into the tent jointly lead into a four-way connector 26, which is configured in the form of a cross connector. FIG. 2 only shows the upper four-way connector 26, since it is a plan view of the supporting framework structure.

In addition, it can be seen that the four-way connector 26 also receives a drain part 19, which, when viewed from above, merges into the drain pipe 20, which, at its end 22, drains collected rainwater or, for example, meltwater away from the roof depression 8 towards the outside of the tent.

Figure 3:
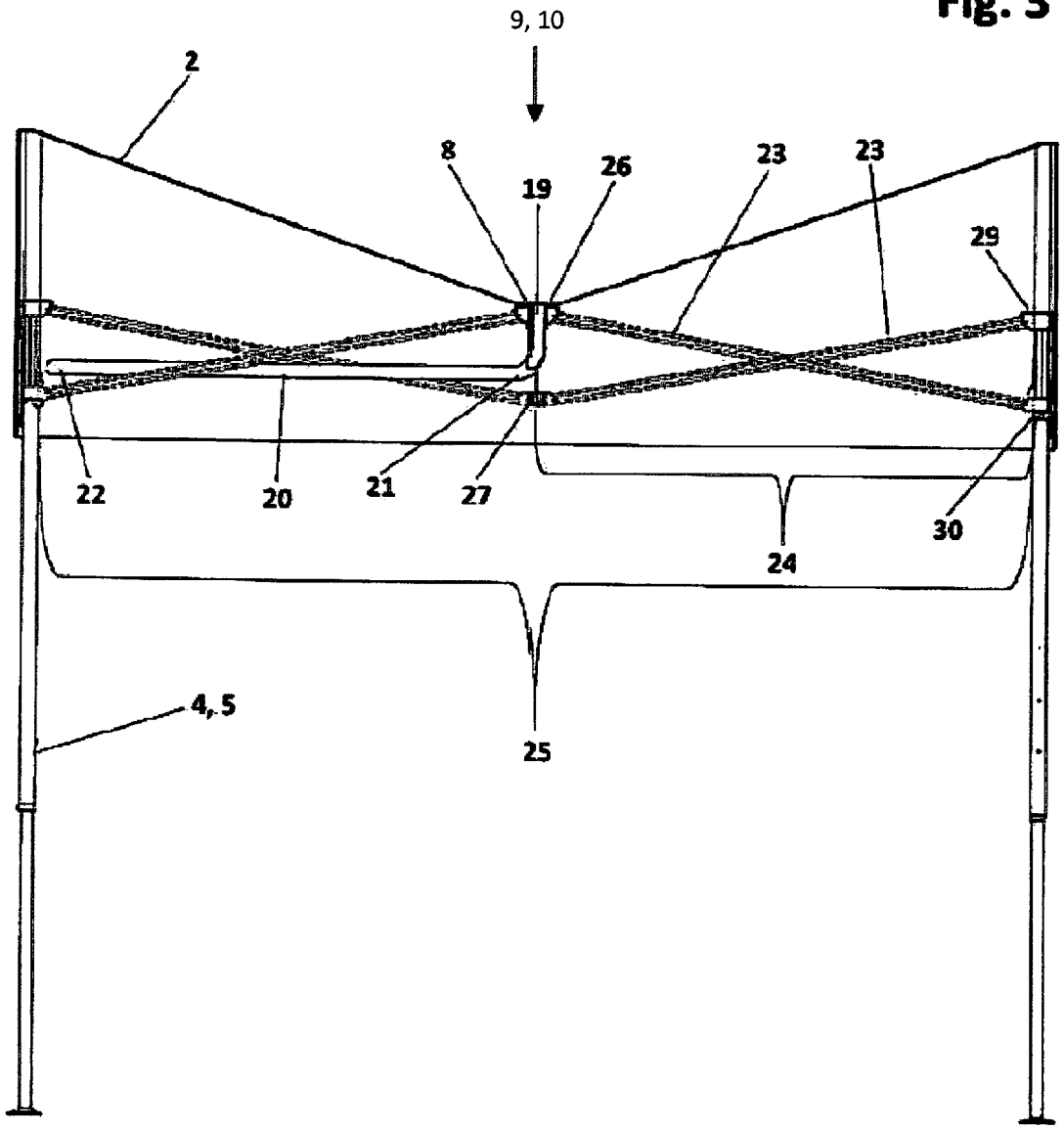
FIG. 3: a sectional view of the tent roof with the roof depression and profile elements as well as the drain pipe according to the first embodiment.

The roof depression 8 and its associated functions can be seen in more detail in FIG. 3. FIG. 3 shows a sectional view of an outer side of the tent 1. It can be seen that the tent roof fabric 2 extends from its suspension on the upper side of the supporting structure 4, 5 and runs towards the inside of the tent. The course is downwardly inclined. The roof depression 8 is located at the lowest point of the tent roof fabric 2. However, this is a flat roof within the meaning of the present disclosure, since it lacks a ridge typical of a tent, a roof apex typical of a tent or the like.

Directed into the inside of the tent, the device 9 for the attachment of the tent roof fabric and for the connection of the profile elements 23 and for the reception of the drain part 19 is connected to the roof depression 8. The device 9 thus receives the drain part 19, which leads into the drain pipe 20, which has an elbow 21 and through the end 22 of which water taken in via the roof depression 8 is drained away.

It can also be seen from FIG. 3 that the profile elements 23 running from the lower three-way connector 30 towards the inside of the tent lead into the upper four-way connector 26, which is provided with a hollow space, into which the drain part 19 is inserted. In addition, it can be seen that the tent roof fabric 2 is attached to the drain part 19 in the area of the roof depression, with relevant details being explained in more detail with respect to FIGS. 5 and 6. The profile elements 23 extending from the upper three-way connector 29, which is located on the respective circumferential outer side of the tent, converge in a lower four-way connector 27 below the roof depression 8.

Furthermore, it can be seen that the scissor-type grid 25 comprises two scissor-type grid sections 24 connected to each other (of which only the right one is indicated). The scissor-type grid section 24 in turn comprises profile elements 23 crossing each other.

Figure 4:
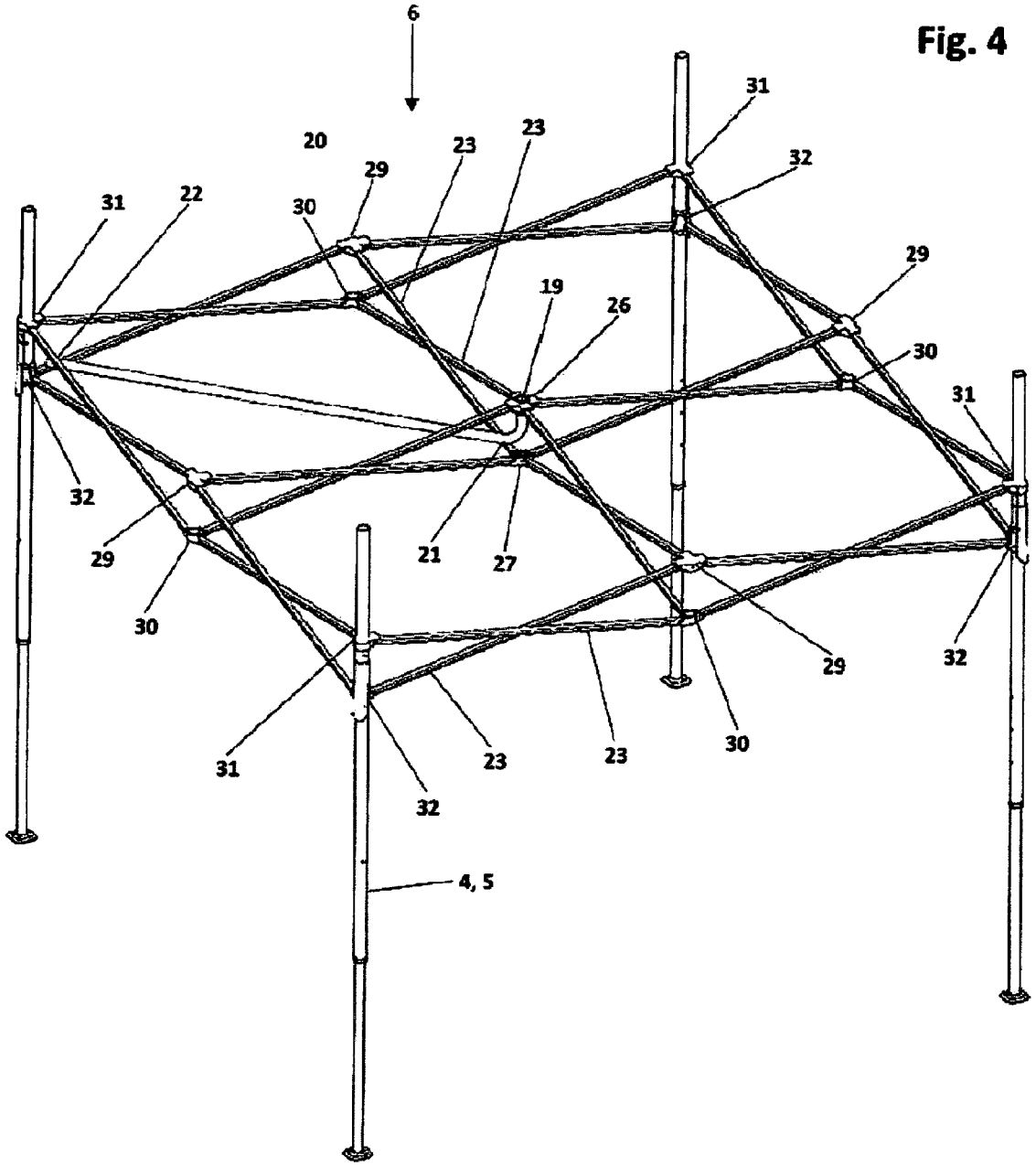
FIG. 4: a schematic diagram of the overall structure of the supporting framework according to the first embodiment.

FIG. 4 shows an overall view of the supporting framework 6 with two scissor-type grid sections 24 arranged on each outer side and comprising two profile sections 23. The respective profile elements 23 are attached to upper corner connectors 31 or lower corner connectors 32, which in turn are arranged on the supporting structure 4, 5. Extending from these corner connectors towards the center of the outer side, the profile elements 23 cross each other and are each received by upper three-way connectors 29 and lower three-way connectors 30. The three-way connectors 29 and 30 are thus located approximately in the center of the outer sides of the tent. In addition, profile elements 23, which are directed into the inside of the tent and are merged crosswise in the four-way connector 26, extend from the lower three-way connectors 30. The profile elements 23, which are guided from the upper three-way connectors 29 towards the inside of the tent, in turn converge in a cross-shaped lower four-way connector 27 approximately in the center of the tent roof. The profile elements 23 thus also form scissor-type grid sections 24, as also shown in FIG. 2.

It can also be seen in FIG. 4 that the upper four-way connector 26 has a tubular configuration and can thus receive the drain part 19, which in turn merges via the elbow 21 into a slightly downwardly guided drain pipe 20, which can drain away collected rainwater or other water at its end 22 via the outer side of the tent.

Figure 7:
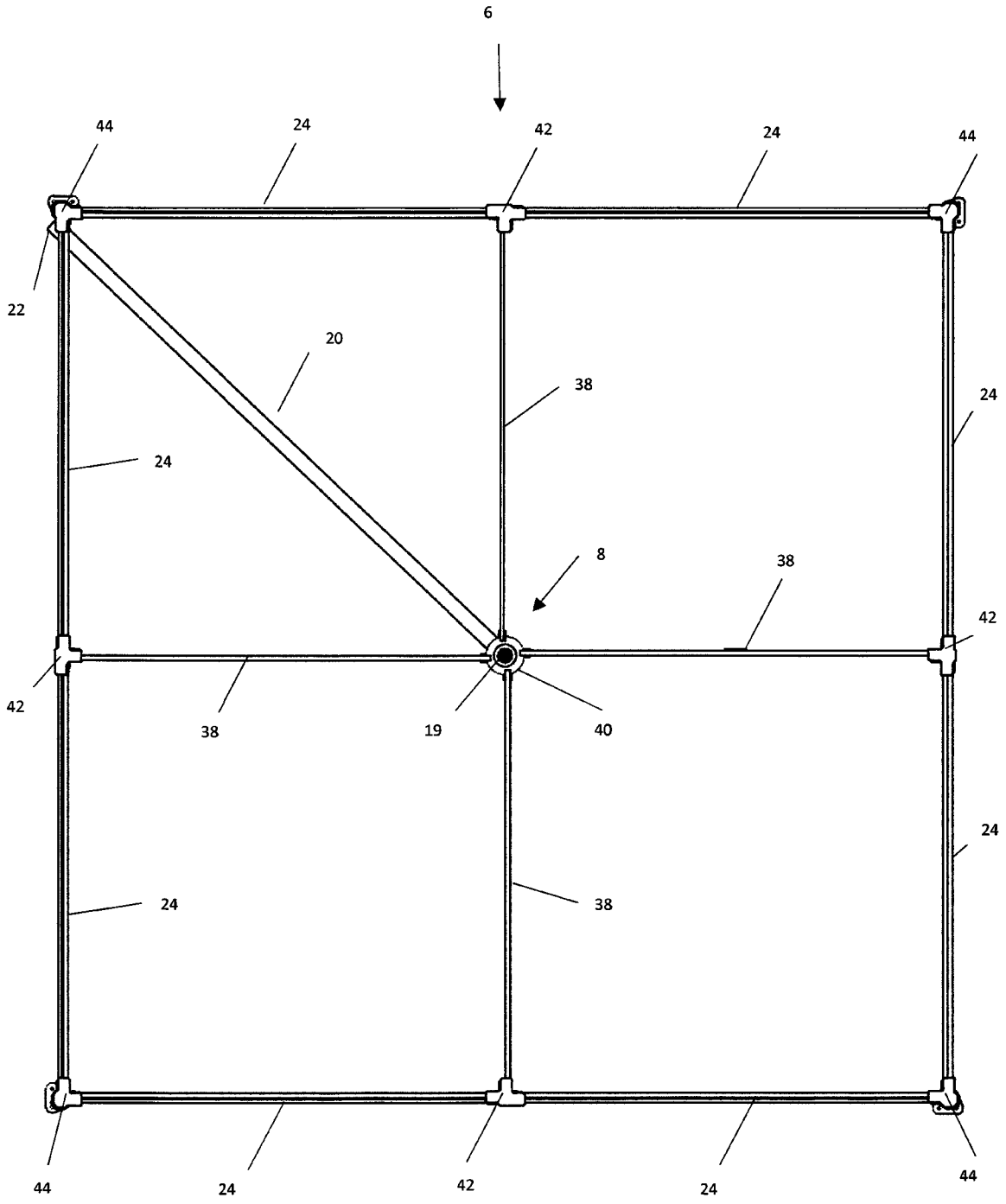
FIG. 7: a profile view of the supporting framework according to the second embodiment as viewed from above.

An exemplary embodiment according to the second embodiment described above will be explained below by reference to FIGS. 7, 8 and 9.

Figure 8:
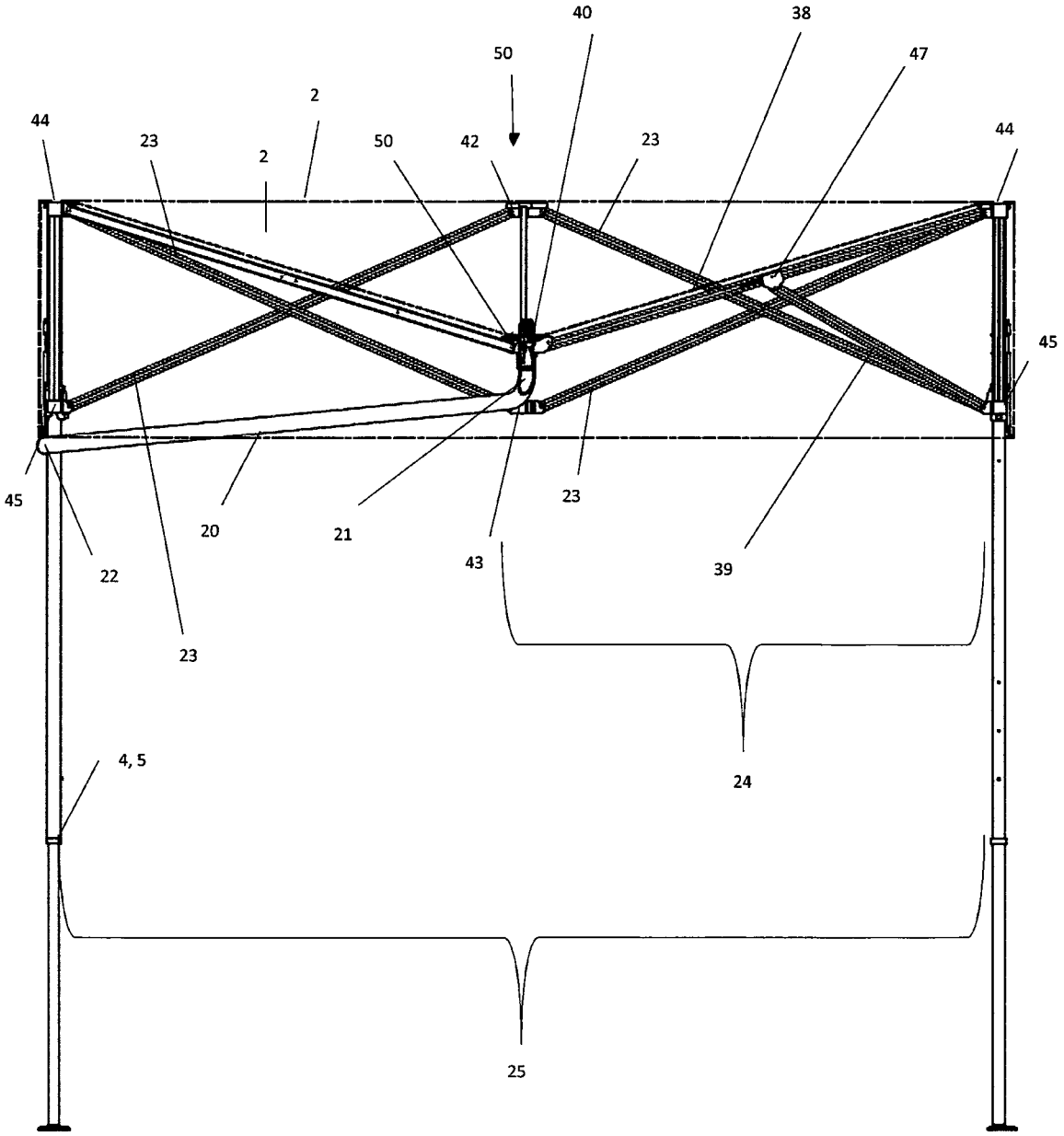
FIG. 8: a sectional view of the tent roof with the roof depression and the profile elements as well as the drain pipe according to the second embodiment.

In the second embodiment, according to FIG. 8, the upper corner connector 44 is arranged at the upper end of the respective (corner) support 4, 5 of the folding tent, while the lower corner connector 45 connector—as compared to the first embodiment—can remain approximately at the position beneath the respective (corner) support. By raising the connection, the scissor-type grid 25 running circumferentially around the outer sides is also moved upwards. This ensures that the tent roof fabric 2 can additionally rest on its outer sides on the scissor-type grid 25 running circumferentially around the outer sides. This has the advantage that the tent roof fabric is additionally supported in case of heavy rain or snow load. This also prevents unwanted ponding of water, also known as pooling, from occurring.

As a result, both upper ends of the scissor-type grid section running circumferentially around the outer sides of the tent are approximately in a position in terms of height corresponding to the raised upper corner connector 44, which is arranged at the upper end of the (corner) support 4, 5. This means that the upper three-way connector 42 receiving the adjacent scissor-type grid section 24 running circumferentially around the outer sides is also located in a position in terms of height which corresponds approximately to the position of the raised upper corner connector 44.

Figure 9:
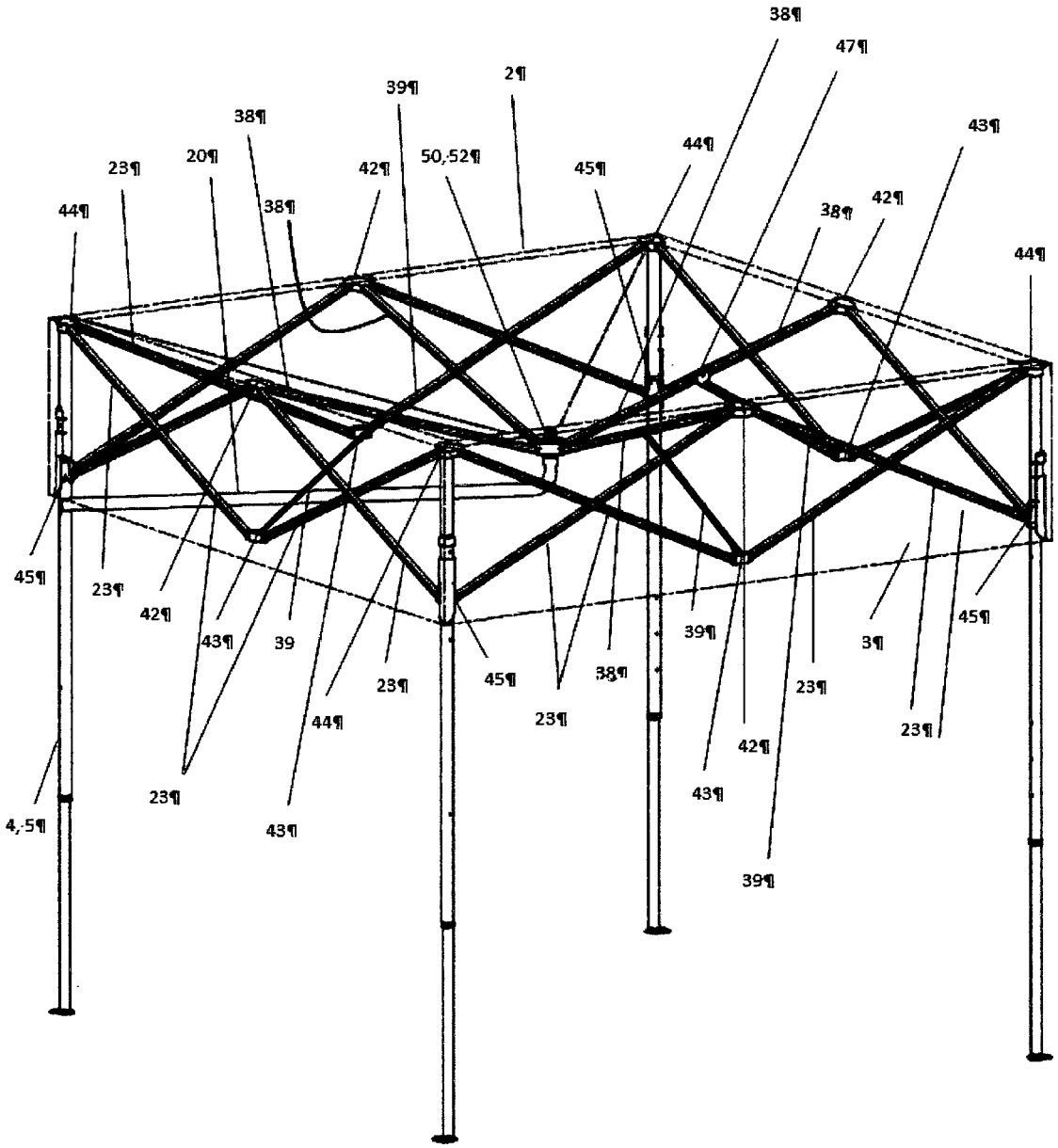
FIG. 9: a schematic diagram of the overall structure of the supporting framework according to the second embodiment.

The lower three-way connector 43, which connects the downwardly extending profile elements 23 of the scissors-type grid sections 24 to each other at their ends, remains approximately at a height corresponding to the arrangement of the lower corner connector 45, cf. FIGS. 8 and 9.

Also in this second embodiment, there is an approximately centrally arranged roof depression 8, which serves the purpose of receiving and connecting to a device for attachment, connection and drainage 50, with the result that in the second embodiment, too, this device is arranged at a lower level than the upper end of the (corner) supports 4, 5 and the upper end of the upper three-way connector 42, cf. FIGS. 8 and 9.

However, the result of the roof depression 8 is achieved in a different way than in the first embodiment:

That is to say the second embodiment does not have scissor-type grid sections 24 branching off from the upper and the lower three-way connectors 42, 43 towards the inside of the tent, as can been seen in FIG. 2.

Instead, profile elements 38 only branch off from the upper three-way connectors 42, which meet centrally in the area of the roof depression 8 in the (only) central connector 40 and are attached there. From the higher starting point of the upper three-way connector 42, these profile elements 38 directed into the inside of the tent thus run towards the inside of the tent, sloping down to the roof depression 8 and to the central connector 40, cf. FIGS. 8 and 9. In the case of a square tent, the central connector 40 is configured in the form of a four-way connector.

Profile elements 39 also extend from the lower three-way connectors 43 in the direction of the inside of the tent. However, they no longer run towards a central connector in the vertical axis beneath the roof depression 8 or the device for attachment, as is the case with the first embodiment. The profile elements 38, 39 thus no longer form scissor-type grid sections 24 crossing each other. Rather, the profile elements 39 directed into the inside of the tent each replace one profile element 23 of the scissors-type grid section 24 and form supports instead. For this purpose, the profile elements 39 directed into the inside of the tent and extending from the lower three-way connectors 43 run at an angle upwards in such a way that they are hinged approximately in the center of the profile elements 38 directed into the inside of the tent and extending from the upper three-way connectors 42 and support them in their course to the central connector 40, cf. FIG. 9.

Figure 6:
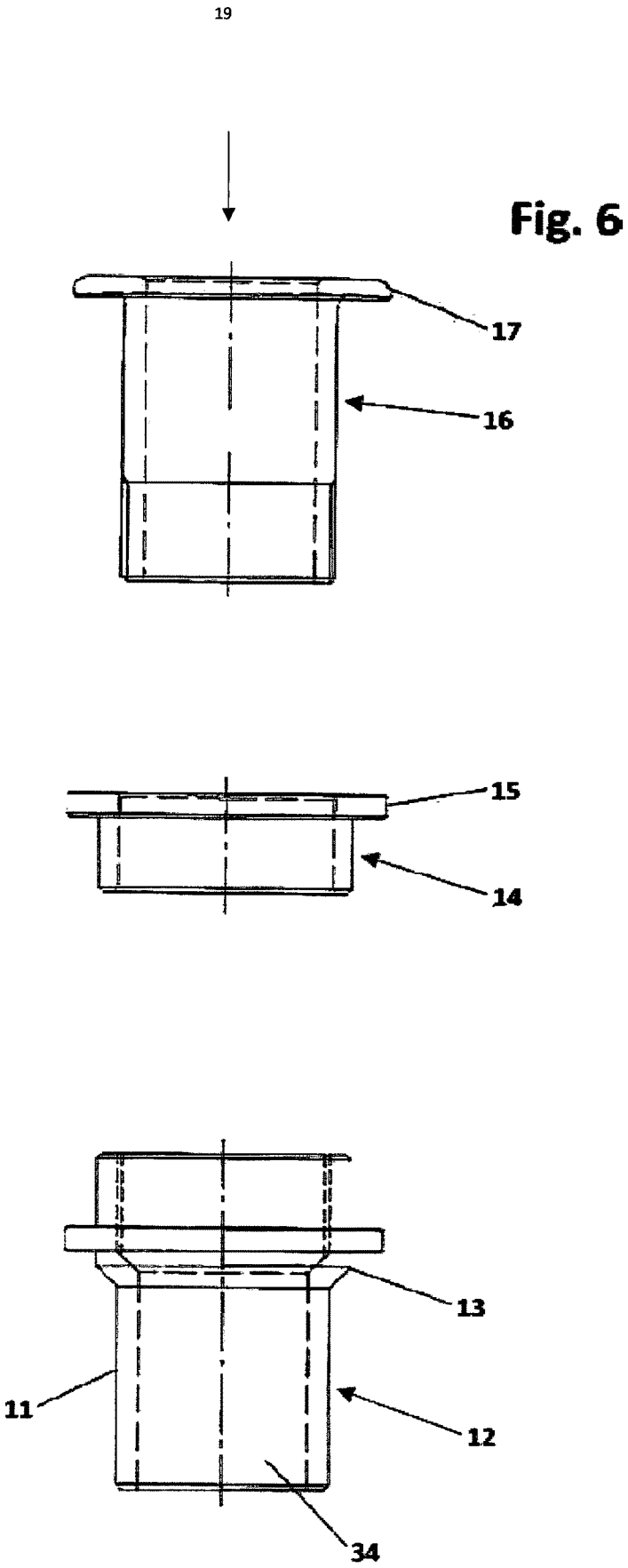
FIG. 6: a schematic diagram of the components of the drain part according to FIG. 5.

FIG. 6 shows the individual parts of the drain part 19 according to an exemplary embodiment. These individual parts include the receiving device 11 for the pipe 20, which in turn comprises a pipe connection part 12 (sleeve-shaped pipe part) and a (conically) widened receiving part 13. The fitting 14, which is a further component of the drain part 19, is inserted into the widened receiving part 13. At its upper end, the fitting 14 has a configuration referred to as a lower circumferential projection 15, which can be configured in the form of a flange, a bead or the like. Both the fitting 14 and the pipe connection part 12 are configured in the form of a pipe. The projection 15 thus comprises the pipe part of the fitting 14. The further roof depression connection part 16 forming part of the drain part 19 is guided via the fitting 14 into the pipe connection part 12 having the shape of a sleeve pipe. The roof depression connection part 16 also has a tubular configuration, with the diameter of the pipe being smaller than the diameter of the tubular configuration of the fitting 14 and the pipe connection part 12 in order that the pipe of the roof depression connection part 16 can be inserted or screwed into these pipe parts. The roof depression connection part 16 in turn has an upper circumferential projection (flange) provided with the reference numeral 17, which in turn can be configured in the form of a flange or a bead or the like, and which thus also closes off the tubular opening of the roof depression connection part.

Figure 5:
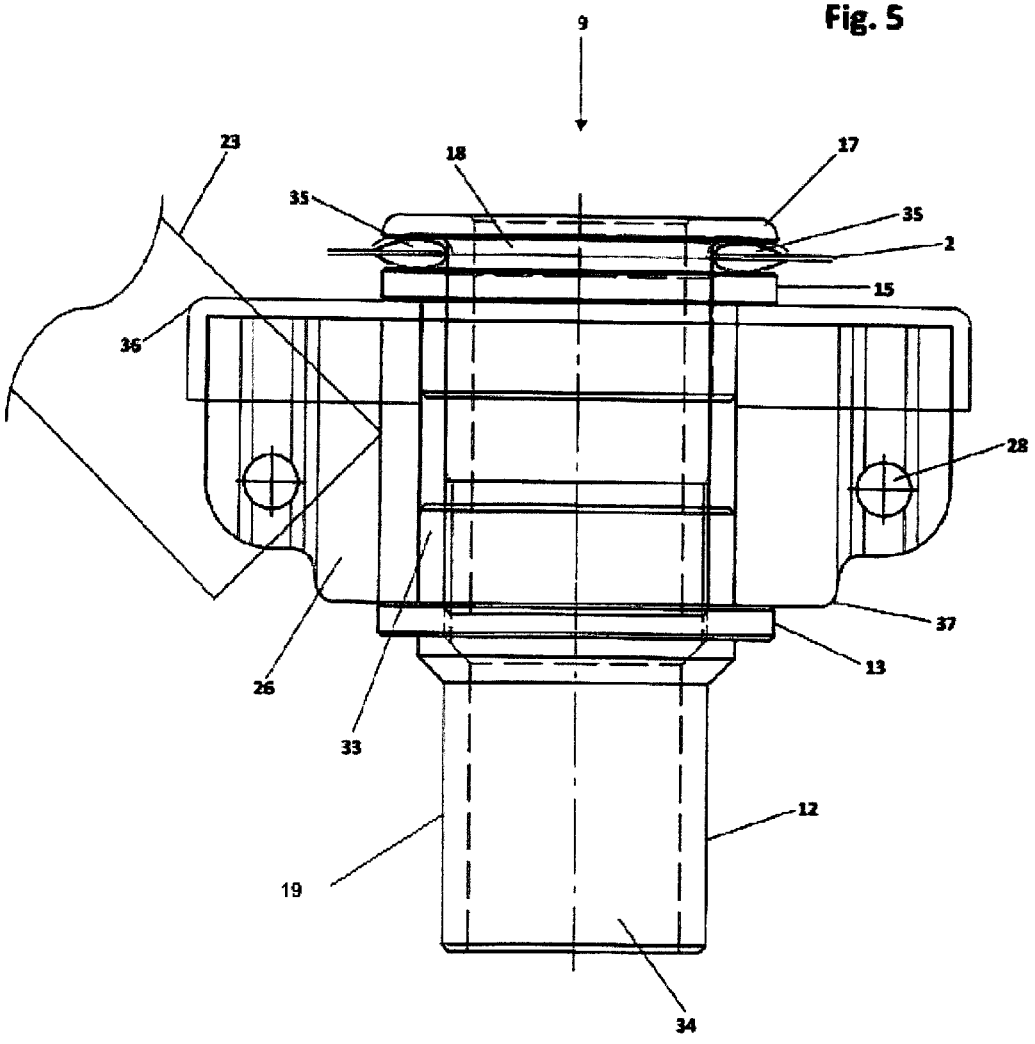
FIG. 5: a schematic diagram of the drain part inserted into a four-way connector.

As can be seen from FIG. 5, the length dimensions and diameters of the tubular roof depression connection part 16 and the fitting 14 are configured in such a manner that a distance 18 remains between the bottom side of the upper circumferential projection 17 of the roof depression connection part 16 and the top side of the lower circumferential projection 15 of the fitting 14 after these components have been joined together. This distance space 18 serves to receive the eye-shaped opening of the tent roof fabric 2 in the area of the roof depression 8 (not shown). This eye-shaped border of the opening of the tent roof fabric is illustrated by the two elliptical bodies 35. This configuration can be described as an eye-shaped ring of the tent roof fabric.

Furthermore, it can be seen from FIG. 5 that, according to this exemplary embodiment, the device 9 is inserted into the hollow space 33 of the upper four-way connector 26. The drain part 19 rests with the bottom side of the lower circumferential projection of the fitting 14 on the shoulder surface 36 of the upper four-way connector 26 so that the drain part 19 cannot slip through the opening 33 of the upper four-way connector 26.

As can also be seen in FIG. 5, the bottom side of the upper four-way connector 26 is followed by the pipe connection part 12, which, together with the hollow space 34 of the drain part 19, merges into the pipe 20 or is part of it (not shown). It can be seen in FIG. 5 that the lower shoulder surface 37 of the upper four-way connector is arranged on the top side of the widened receiving part 13 of the pipe connection part 12.

In addition, the hinge points 28 for the reception of a respective profile element 23 can also be seen.

Figure 10:
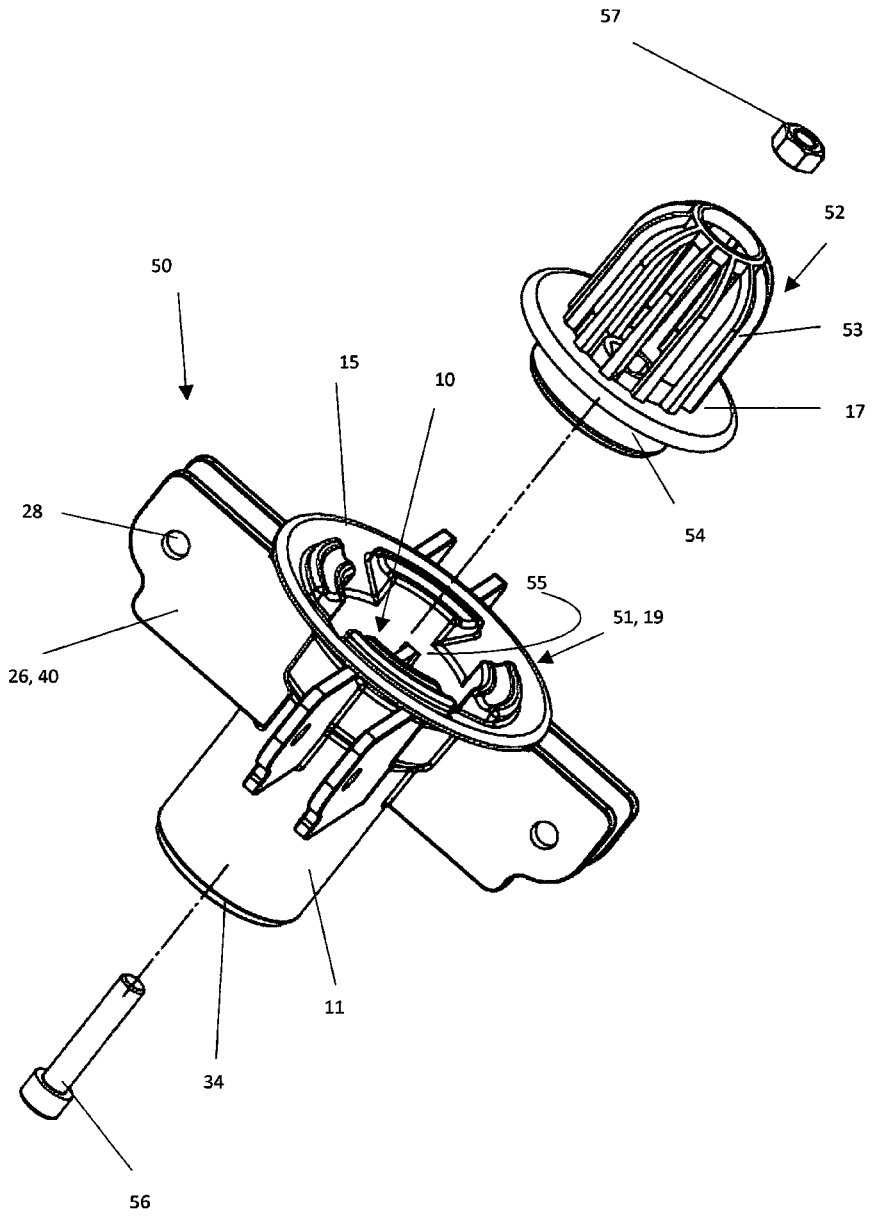
FIG. 10: a schematic diagram of the drain part inserted into a four-way connector according to another embodiment.
Figure 11:
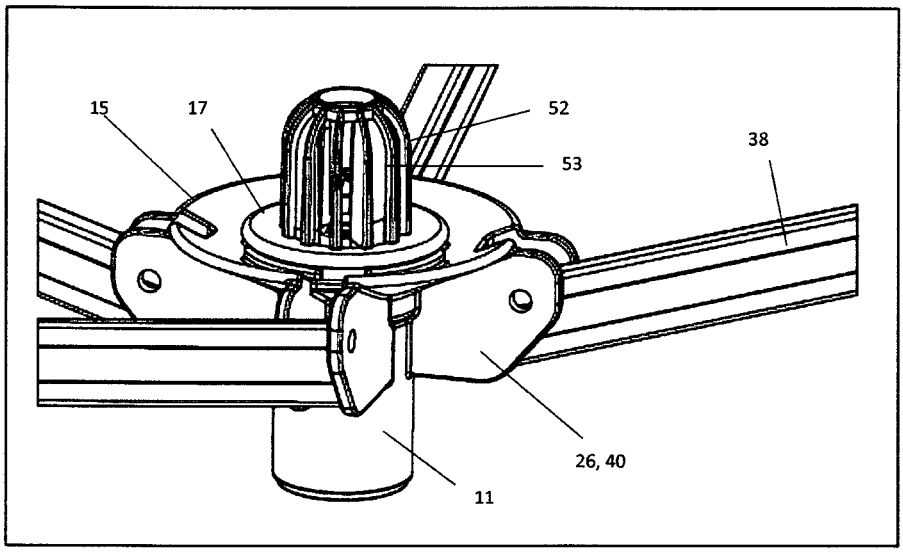
FIG. 11: a detail view of the drain part according to FIG. 10.
Figure 12:
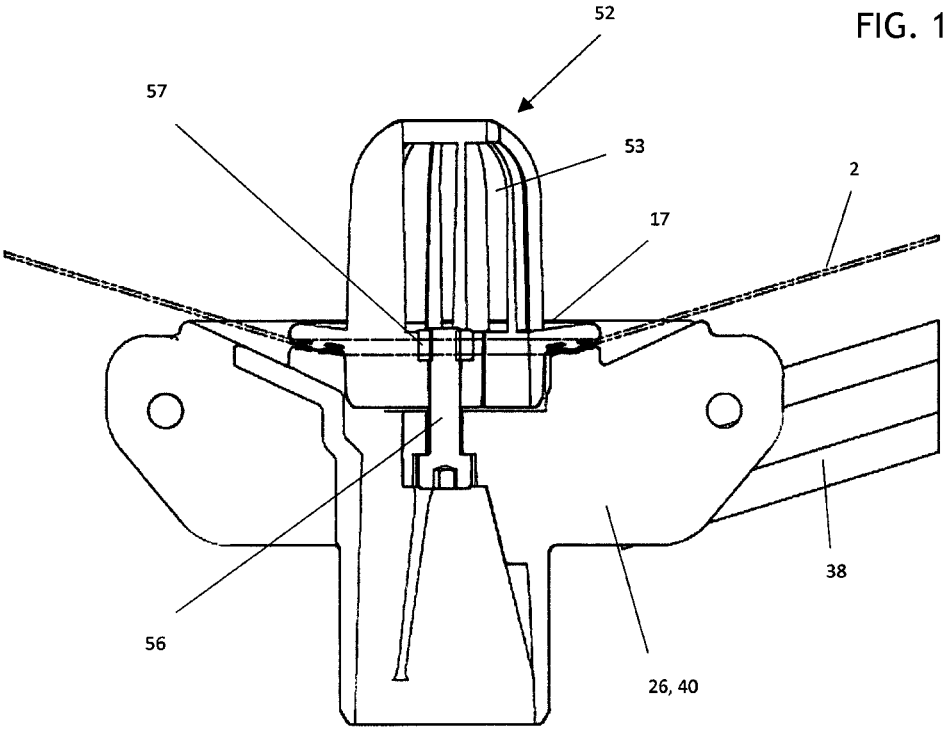
FIG. 12: a sectional view of the drain part according to FIG. 10.

A further exemplary embodiment of a device for attachment, connection and drainage 50 is shown in FIGS. 10, 11 and 12 and is explained as follows:

In another embodiment of the device for attachment, connection and drainage, the device has a connection part 51 and a drain part 19. Both parts thus have different functions; in terms of construction, however, they can be configured as one component. They preferably have a filter or a strainer in order to avoid clogging caused, for example, by dirty rainwater, fallen leaves or the like.

For this purpose, the device for attachment, connection and drainage 50 is also preferably made up of several parts, FIGS. 10, 11, 12. Preferably, it receives the actual connection part 51 and the strainer 52, with the term "strainer" also including synonymous terms such as filter or other components for the segregation or separation of substances or fluids.

The actual connection part 51 comprises the central connector 40. The central connector 40 receives the hinged connection 28 of the profile elements 38 directed into the inside of the tent.

The connection part 51 also has a hollow space 10, 34, through which the rainwater can drain off. For this purpose, it is preferred that the connection part 51 has a tubular configuration and thus forms a receiving device for the drain pipe as well as the elbow of the drain pipe, as has already been described for said one embodiment.

On its upper side, the connection part 51 has a receiving space 55 to receive a fitting 54 of the strainer 52. The strainer 52 is inserted, screwed or otherwise fixed into this receiving space 55 by means of the fitting 54, which may be an integral component of the strainer 52.

The upper side of the connection part 51 is also provided with a lower circumferential projection 15, on which the opening of the tent roof fabric 2 reinforced with eyes, for example, is placed. This opening of the tent roof fabric 2 is attached by fixing the strainer 52, which also has an upper circumferential projection 17, in the receiving space 55. The opening of the tent roof fabric 2 reinforced with eyes, for example, is thus clamped between these two projections, cf. FIG. 12.

The strainer 52 may have web-shaped strainer profiles 53 or comparable separation profiles. Irrespective of this example, it may be sufficient to connect the upper circumferential projection 17 (flange) to the connection part 51 (not shown).

The strainer 52 and the connection part 51 are preferably connected by means of a connecting element 56, for example a screw, in a permanent but preferably detachable manner. A counter nut 57 for the connecting element 56 is provided.

LIST OF REFERENCE NUMERALS

1 tent
2 tent roof fabric
3 screen of the tent roof
4 supporting structure
5 support
6 supporting framework
7 flat roof
8 roof depression
9 device for attachment, connection and drainage
10 hollow space
11 receiving device for the pipe
12 pipe connection part
13 widened receiving part
14 fitting
15 lower circumferential projection
16 roof depression connection part
17 upper circumferential projection
18 distance between 15 and 17
19 drain part
20 drain pipe
21 elbow of the drain pipe
22 end of the drain pipe
23 profile element
24 scissor-type grid section
25 scissor-type grid
26 upper central connector
27 lower central connector
28 hinge point for the profile element
29 upper three-way connector
30 lower three-way connector
31 upper corner connector
32 lower corner connector
33 hollow space of the upper four-way connector
34 hollow space of the drain part
35 eye-shaped ring of the tent roof fabric
36 shoulder surface
37 lower shoulder surface
38 profile element directed into the inside of the tent
39 profile element directed into the inside of the tent (support)
40 central connector
41 remains unassigned
42 upper three-way connector
43 lower three-way connector
44 upper corner connector
45 lower corner connector
46 supporting rod
47 hinging element for the supporting rod
48 remains unassigned
49 remains unassigned
50 device for attachment and connection to the drain
51 connection part
52 strainer
53 strainer profile
54 fitting
55 receiving opening for the fitting 54
56 connecting element
57 counter nut for the connecting element

The invention claimed is:

1. A tent with a flat roof comprising:
a supporting framework comprising:
a plurality of outer profile elements;
a plurality of inner profile elements; and
scissor grid sections that are arranged on outer sides of the tent;
wherein respective scissor grid sections comprise two of the outer profile elements crossing to form each scissor grid section;
wherein respective outer sides of the tent comprise adjacent scissor grid sections that are connected to each other using an upper three-way connector and a lower three-way connector;
wherein at least one of the three-way connectors is connected to a lower central connector using an inner profile element running down and towards an inside of the tent;
a tent roof fabric; and
a depression in the tent roof fabric, which merges into a device for attaching the tent roof fabric to the supporting framework and for draining off water;
wherein the device:
has a hollow space for drainage; and
is furthermore configured to receive the inner profile elements; and
wherein the tent is a folding tent.

2. The tent according to claim 1, characterized in that the device receives the inner profile elements, and comprises the lower central connector.

3. The tent according to claim 1, characterized in that the device comprises a drain part and a connection part.

4. The tent according to claim 3, characterized in that the device has a strainer.

5. The tent according to claim 1, characterized in that the device for attaching the tent roof fabric and for draining off water is configured in such a manner that the device for attaching the tent roof fabric and for draining off water allows a connection to a drain pipe.

6. The tent according to claim 5, characterized in that the drain pipe has an elbow-shaped deflection, the drain pipe sloping downward toward an outer side of the tent.

* * * * *